United States Patent [19]

Rickmann

[11] 4,400,599

[45] Aug. 23, 1983

[54] FLEXIBLE CABLE MECHANICAL INTERLOCK FOR ELECTRIC CONTROL DEVICES

[75] Inventor: Bernard C. Rickmann, Peru, Ind.

[73] Assignee: Square D Company, Palatine, Ill.

[21] Appl. No.: 316,618

[22] Filed: Oct. 30, 1981

[51] Int. Cl.[3] ..... H01H 9/26

[52] U.S. Cl. ..... 200/50 C

[58] Field of Search ..... 200/17 R, 18, 50 C, 200/161; 74/471 R, 483 R, 491

[56] References Cited

U.S. PATENT DOCUMENTS 2,328,801 9/1943 Hammell ..... 200/50 C 3,448,226 6/1969 Mading et al. ..... 200/16 A X

*Primary Examiner*—J. R. Scott

*Attorney, Agent, or Firm*—Larry I. Golden; Richard T. Guttman; Norton Lesser

[57] ABSTRACT

An interlock assembly for preventing two electrical control devices from simultaneously assuming a closed or "ON" position. The assembly comprises two subassemblies which are operably connected by a push/pull flexible cable. Each subassembly includes a frame member which carries a reciprocally movable plunger unit. A stop link is pivotally connected to the plunger unit at one end and carries a guide rod at its opposite end. The guide rod is retained within a guideway formed in the frame member which has a main longitudinally extending portion and an offset portion. The plunger unit is prevented from reciprocal movement to a depressed position when the guide rod is in the offset portion whereas reciprocal movement of the plunger unit to a depressed position is permitted when the guide rod is in the main portion of the guideway. The cable connects the respective guide rods in a manner which prevents both rods from being positioned in the main portion of the respective guideways, whereby only one plunger unit is able to assume a depressed position at any given time.

11 Claims, 7 Drawing Figures

FLEXIBLE CABLE MECHANICAL INTERLOCK FOR ELECTRIC CONTROL DEVICES

BACKGROUND OF THE INVENTION

1. Field of the Invention

This invention relates to an electric control system including at least two electrical control devices and a mechanical interlock therebetween preventing both control devices from simultaneously assuming a closed or "ON" position. More particularly, the instant invention interlocks two circuit interrupters and prevents the switching of one of the interrupters to the "ON" position while the other interrupter is "ON".

2. Description of the Prior Art

Pivoted beam type mechanical interlocks have been used between two circuit interrupters to prevent both interrupters from being in their closed or "ON" position simultaneously. The circuit interrupters each include a stationary contact and a movable contact and blade. Each interrupter also includes a plunger extending through an opening in the circuit interrupter housing which is associated with the movable contact blade such that the plunger is pushed to an outward position when the contacts are in a closed position and is returned, or is free to be returned, to its original or inward position when the contacts are opened.

The circuit interrupters are positioned such that the plungers engage the beam on opposite sides of the pivot whereby the extended plunger of one circuit interrupter pivots the beam to prevent extension of the plunger of a second circuit interrupter thereby preventing the second interrupter from assuming a contact closed position while the first interrupter is closed.

Another type of interlock which will be referred to as a walking beam interlock is illustrated in U.S. Pat. No. 3,303,300, issued Feb. 7, 1967 and assigned by the inventor, Merlin Y. Turnbull, to the assignee of the present invention. The beams of this interlock are pivotally connected to levers near opposite ends, which levers are then pivotally connected to the plunger assembly of the interlocked circuit interrupters.

The pivoted and walking beam interlock assemblies are essentially restricted for use with circuit interrupters positioned in side by side relationship. The length of the beam also dictates the spacing of the associated circuit interrupters.

Furthermore, the pivoted or walking beam interlocks are not appropriate for use with circuit interrupters having three independent sets of main contacts with a common trigger linkage that provides for simultaneous opening or closing operations. If one set of contacts in a three pole circuit interrupter should weld closed and the common triggering linkage should happen to operate to open the contacts, only two sets of contacts would open while the welded contacts would remain closed. An effective interlock system must be provided which will prevent the closing of a second circuit interrupter while any of a number of poles of a first circuit interrupter remains closed. The interlock system must be effective irrespective of the number of poles in each of the circuit interrupters.

SUMMARY OF THE INVENTION

According to the present invention there is provided an interlock for circuit interrupters which includes two subassemblies. Each subassembly includes a plunger bar unit which is in engageable relationship to the plungers of an associated circuit interrupter. The plunger bar units of each subassembly can assume an "ON" position, indicating at least one set of closed contacts in an associated circuit interrupter, an "OFF" position, indicating all contacts of an associated circuit interrupter are in an open position, and a "LOCK" position, indicating all contacts of an associated circuit interrupter are open and preventing those contacts from being closed.

A flexible push-pull cable having reciprocally movable opposite ends operably connects the plunger bar units of each subassembly through a linkage assembly such that when one subassembly assumes an "ON" position the other subassembly is placed in the "LOCK" position.

In accordance with this invention, it has been found that much more versatility is provided for the interlocking of spaced apart circuit interrupters. This interlocking assembly provides for the interlocking of circuit interrupters which assume a side by side, stacked, or angularly offset association. Distance between the interrupters can also readily be varied. Circuit interrupters of different sizes can be interlocked.

The present invention will also prevent a second circuit interrupter from being closed when the contacts of one of the poles of a first circuit interrupter are welded closed even though a common triggering linkage has operated to open the contacts of the remaining poles.

Other objects and advantages will become apparent from the following description and accompanying claims taken together with the Drawings.

DESCRIPTION OF THE PREFERRED EMBODIMENT

Figure 1:
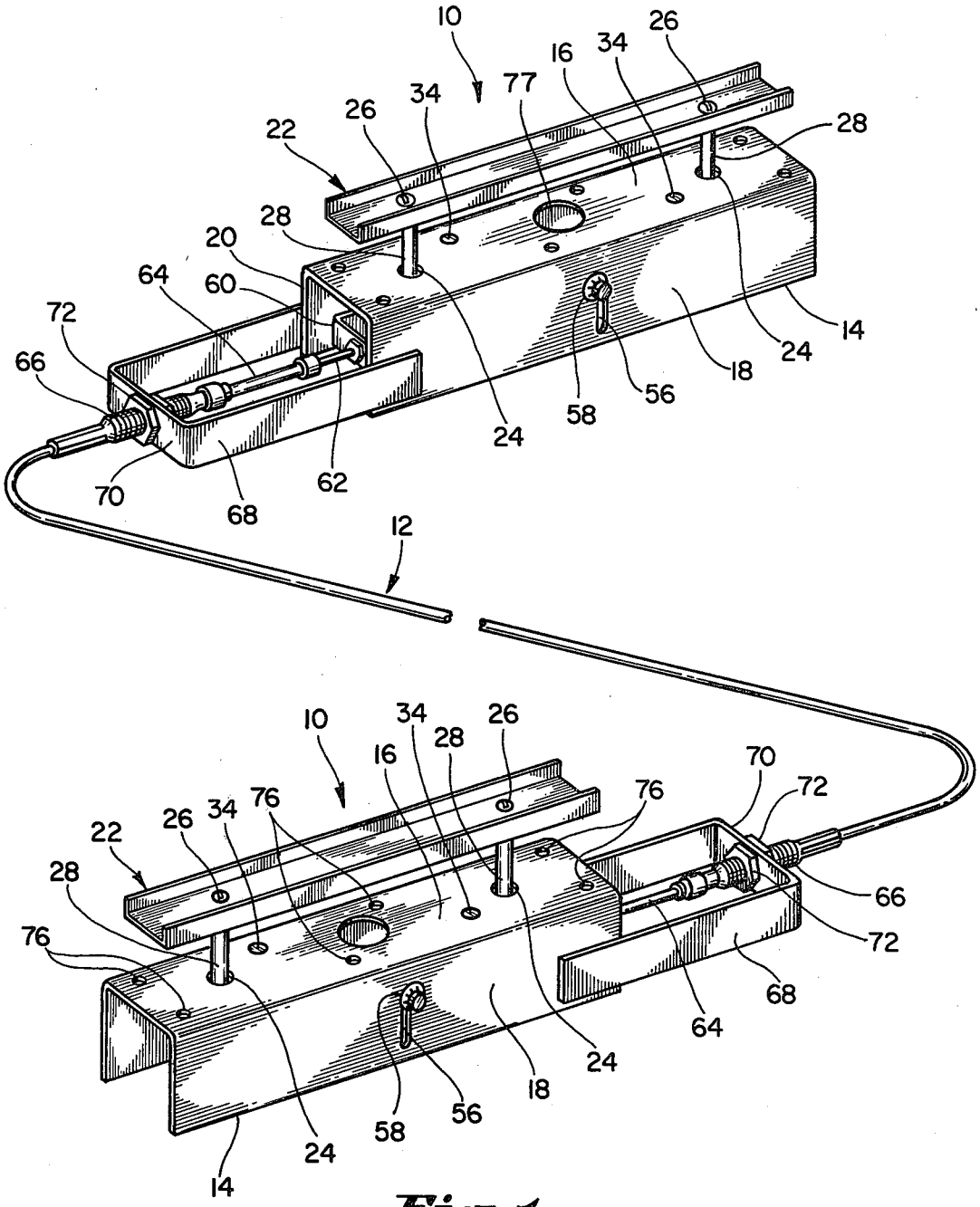
FIG. 1 is a perspective view showing the two subassemblies of the interlock constructed in accordance with the principles of this invention.
Figure 2:
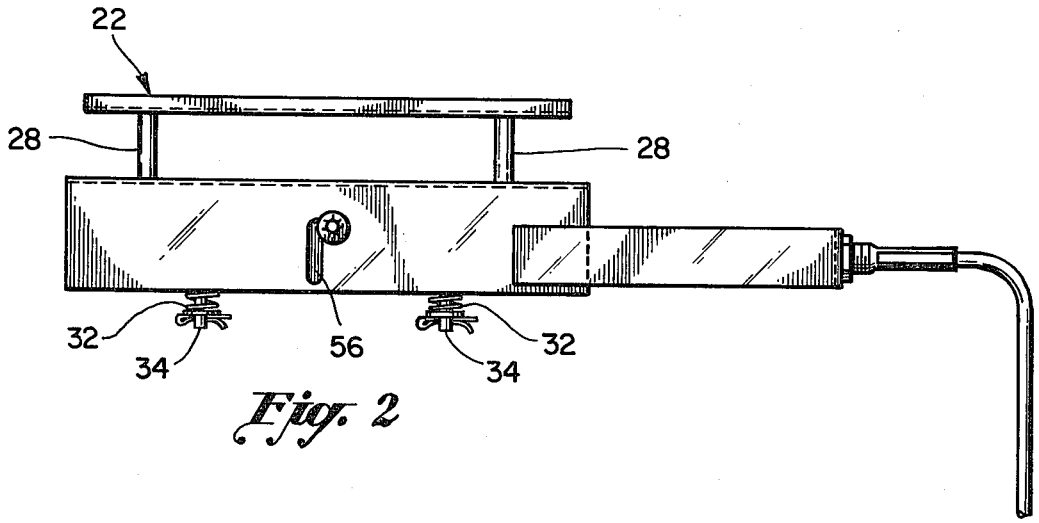
FIG. 2 is a top view of one of the subassemblies shown in FIG. 1 corresponding to a contact open position of an unshown associated circuit interrupter.

Referring to the drawings, FIG. 1 shows the two main subassemblies 10 which are connected by a flexible push/pull cable 12. Each subassembly comprises a generally U-shaped metal frame 14 with base 16 and side legs 18 and an associated plunger bar 22 mounted for reciprocal movement both toward and away from base 16. The base of each U-shaped metal frame includes two apertures 24 through which extend a pair of screws 26. The plunger bar 22 is secured at the top end of the screw, captured between the screw head and spacers 28 which fit in sleeve-like fashion around screws 26. The bottom portion of screws 26 are threadingly received by a generally U-shaped bar of bracket 30 nestingly received between the side walls of metal frame 14. The plunger bar 22 and the connected bar 30 form a plunger unit for each subassembly.

Figure 5:
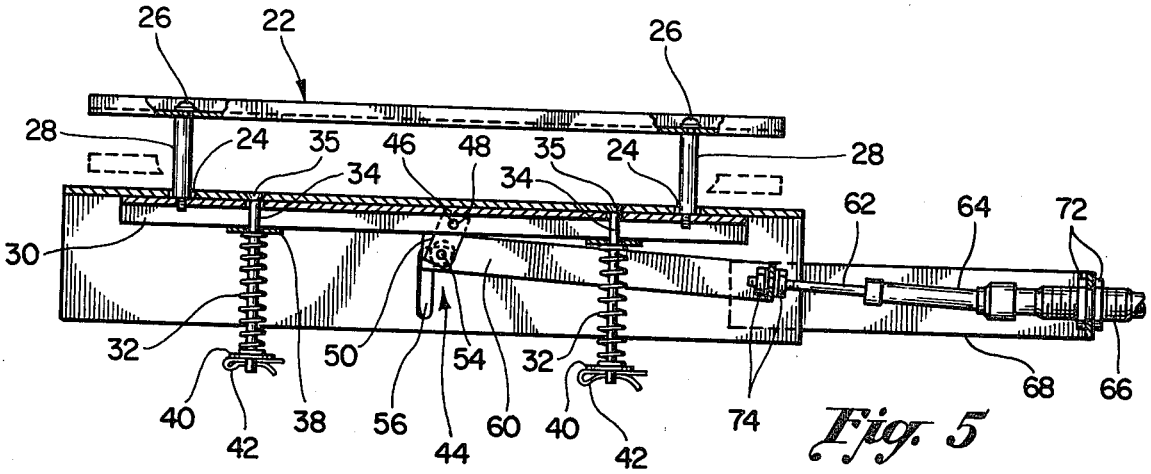
FIG. 5 is a top view taken along lines 5—5 in FIG. 4 depicting a subassembly in the contact open position as shown in FIG. 2.
Figure 6:
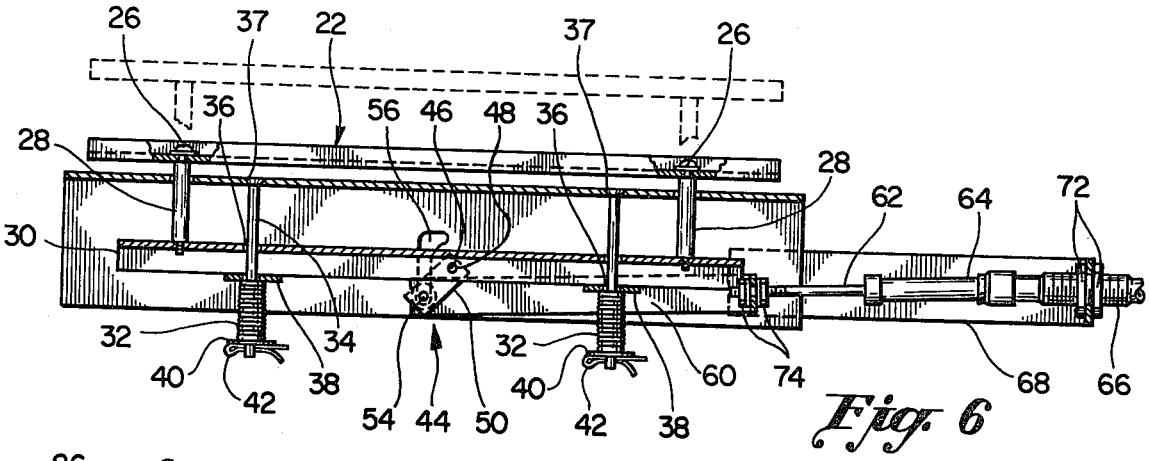
FIG. 6 is a top view taken along lines 6—6 in FIG. 4 depicting a subassembly in the contact closed position as shown in FIG. 3.

The U-shaped bracket 30 is biased toward base 16 by springs 32. As best shown in FIGS. 5 and 6, the springs 32 encircle pins 34 which are mounted in base 16 and extend parallel to side legs 18 and 20 of metal frame member 14. Pins 34 also extend through apertures 36 in bracket 30 and apertures 37 in base 16. Each pin includes a head 35 which engages base 16 and retains pins 34 from passing through apertures 36. The springs 32 are captured at one end by generally U-shaped retaining bracket 38 which is welded to the side legs 33 of bracket 30 and through which pin 34 also extends and at the other end by washer 40 which is retained by clip 42 which extends through a hole or passage in each pin 34. Each spring biased plunger bar unit which includes the plunger bar 22 and connected bracket 30 is connected through a linkage assembly 44 to a respective end of flexible cable 12.

Each linkage assembly 44 includes a first pivot rod 46 which extends through holes 48 in the side legs 33 of U-shaped bracket 30. A pair of short, generally rectangular stop links 50, each having a first aperture at one end which receives an outer portion of pivot rod 46, are retained by clips 52 on the pivot rod outwardly disposed from the legs 33 of bracket 30.

Each link 50 also has an aperture at its opposite end through which extends a guide rod 54 in each subassembly. The guide rod 54 extends at opposite ends through a dog leg shaped aperture 56 found in side legs 18 and 20 of metal frame member 14. The apertures are in mirror image relationship to each other, with the guide rod positioned across side legs 18 and 20 in perpendicular relationship thereto. The edges of apertures 56 act as a guideway for rod 54 which is retained therein through the use of retainer clips 58 or some other suitable retaining means.

Each linkage assembly also includes an elongate, generally U-shaped bracket 60 pivotally mounted through the distal end of each of its legs on guide rod 54 between the side leg 18 or 20 of frame 14 and a respective adjacent link 50. The bight portion of each bracket 60 threadingly receives a reciprocally movable end portion 62 of flexible cable 12. The opposite end portions 62 of cable 12 are telescopically received in sleeves 64 which are connected to threaded fastening portions 66.

Welded to one end of the sides 18 and 20 of the frame 14, on each subassembly, are the distal leg portions of generally U-shaped mounting brackets 68 which include bight portions 70, each having an aperture through which cable 12 extends. The legs of each bracket 68 extend in a generally coplanar relationship to side legs 18 and 20 of frame 14. A pair of nuts 72 are threadingly received on the fastening portion 66, capturing bight portion 70 of bracket 68 therebetween. The nonreciprocating portions of cable 12 can thereby be adjustably secured to the bight portion 70 of each subassembly.

Nuts 74 are also provided on the threaded portion of reciprocally movable end portions 62 of the cable on each side of the bight portion of bracket 60. Minor adjustment is thereby provided in order to facilitate proper operation of the interlocks which will later be discussed.

The push-pull cable in the preferred embodiment has stainless steel wire and is coated with an electrical insulating material. The opposite ends are identical and a total movement of 0.25 inches is provided for travel. Because of the short travel distance, low friction is important. The cable should be capable of withstanding a pulling force of 50 lbs., while it will not be subjected to compression.

The offset or dog leg portions of apertures 56 are positioned adjacent base 16 and extend toward U-shaped bracket 68 in each of the subassemblies.

Link 50 and guide rod 54 of each subassembly are pivotally associated with rod 46 to move forward toward the cable or rearward away from the cable. The pivoting motion of each pin is, of course, restricted by the edges of dog leg apertures 56 through which each pin extends. The pivot motion of guide rod 54 above pivot rod 46 is translated to a pulling force of movable cable portion 62 through movement of bracket 60. The length of the cable is selected and the nuts 72 and 74 are adjusted on each end of the cable in order to prevent the rods 54 of each subassembly from simultaneously assuming a rearward position, i.e., in order for the rod 54 of one subassembly to be in the rearward position, rod 54 of the other subassembly must be in the forward position.

Figure 7:
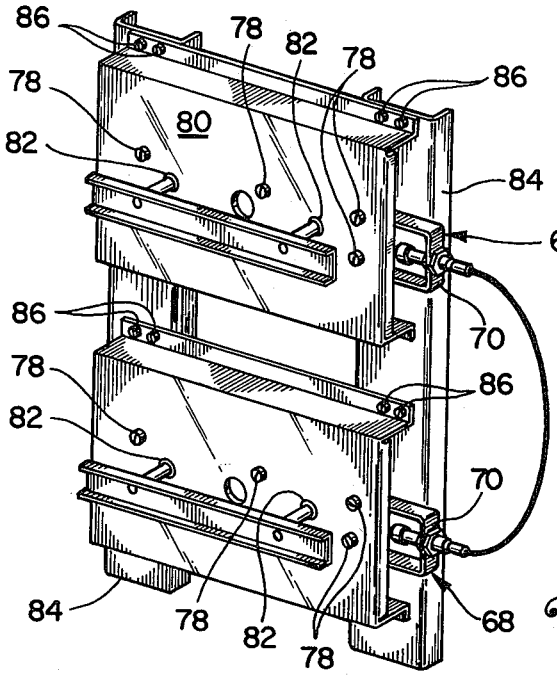
FIG. 7 is a perspective view of the assembly shown in FIG. 1 mounted for use with associated circuit interrupters.

The base of metal frame 14 includes apertures 76 through which fasteners 78 may extend to secure each subassembly to a support 80. Supports 80 may be mounted on side rails 84 through the use of bolts 86 or some other fastening device. As shown in FIG. 7 of the drawings, screws 26 and spacers 28 may extend through openings 82 in supports 80, thereby positioning plunger bar 22 on the circuit interrupter mounting side of support 80.

Figure 3:
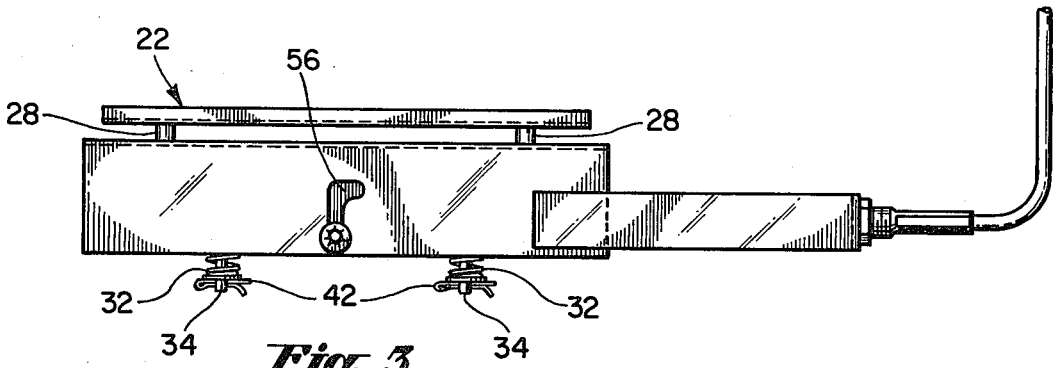
FIG. 3 is a top view of the other subassembly shown in FIG. 1 corresponding to a contact closed position of an unshown associated circuit interrupter.
Figure 4:
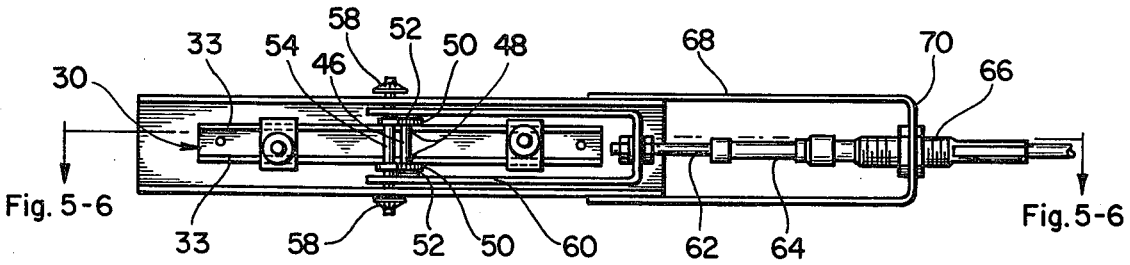
FIG. 4 is a side elevation view of one of the subassemblies shown in FIG. 1.

Each of the subassemblies 10 are shown in an open position in FIG. 1 of the drawings. As can be seen, each plunger bar is spaced a substantial distance from the base 16 of frame 14 indicating that none of the plungers of an associated circuit interrupter (not shown) are assuming an outward position at that particular time. Either of the plunger bars 22 may be depressed to an "ON" position as shown in FIG. 3 wherein the plunger bar is positioned in proximate association or close relationship to the base of the metal frame. Linkage assembly 44 is thereby moved to the position shown in FIG. 6 as guide rod 54 is pivoted away from cable 12 and moved upward along the edges of the elongated portions of apertures 56 away from the offset portion. Bracket 60, having its opposite legs connected to guide rod 54, is also pulled away from cable 12 which pulls the directly connected reciprocating portion 62 of the cable outward eliciting an inward pull of the opposite reciprocating portion of the cable which is connected to the other subassembly whereby, as shown in FIG. 5, bracket 60 of the other subassembly pulls guide rod 54 into a "LOCK" position within the dog leg portion of aperture 56. Unless the reciprocating portion of the locked flexible cable is free to be pulled outward, guide rod 54 of the locked subassembly cannot be guided rearward along the edges of apertures 56 in order to permit the guide pin to travel upward along the elongated portion of apertures 56 and, therefore, plunger bar 22 of the locked subassembly cannot be pushed inward. Only when guide rod 54 of one subassembly is positioned at the lower or dog leg portion of the aperture can the plunger bar of the other subassembly be pushed inward. Therefore, if any pole of a first circuit interrupter is in a closed or "ON" position, the associated plunger will be extended outward causing the associated plunger bar to be pushed against the biasing force of the springs to an inward position whereby the associated guide rod is moved to the upper elongated portions of the guiding apertures which causes an outward movement of the directly connected reciprocally movable portion of the cable and a corresponding inward movement of the reciprocally movable cable connected to the other subassembly which pulls the guide rod of the other subassembly into the dog leg portions of the apertures thereby locking the plunger unit of the other subassembly in the outward position and preventing the associated circuit interrupter from being switched to the "ON" position.

An alternative embodiment of the present interlock assembly may be provided by removing plunger bar 22 along with screws 26 and sleeves 28. Opening 77 is provided in base 16 of frame 14 through which a plunger of an associated circuit breaker could extend in order to bear directly against bracket 30. The interlock assembly then works in the same manner as previously described except that movement of bracket 30 is not imparted through plunger bar 22 and its extended connection to the bracket.

It is understood that various other modifications may be made in the structure shown and described herein without departing from the spirit and scope of the invention, and it is intended that these modifications are intended to be comprehended within the meaning and range of equivalents of the appended claims.

I claim:

1. An interlock assembly for a first circuit interrupter separated from a second circuit interrupter by a predetermined distance, each circuit interrupter having at least one main set of contacts and a reciprocally movable plunger associated with each main set of contacts, said plungers each operably mounted to reciprocate to an outward position in response to said associated contacts assuming a closed position and to an inward position in response to said associated contacts assuming an open position, said assembly comprising:

first and second lock means respectively associated with the plungers of said first and second circuit interrupters for selectively preventing any of said plungers associated with said first circuit interrupter from simultaneously assuming an outward position with any of said plungers associated with said second circuit interrupter, said first and second lock means each including a frame member (14);

a plunger bar unit (22, 30) associated for reciprocal movement with respect to said frame member between an outward and an inward position; biasing means (32) for biasing said plunger unit toward said outward position, a stop link (50) having one end pivotally connected to said plunger unit and having an opposite pivotable end;

a guide rod (54) connected to said opposite end of said stop link;

a guideway (56) formed in said frame member receiving said guide rod;

said guideway having a main portion and an offset portion; said guide rod movable along said main portion of said guideway in response to movement of said plunger unit from said outward position to said inward position, a flexible push/pull cable having dependent reciprocally movable ends respectively connected to said guide rods, said cable movable from a first position wherein said guide rod of said first lock means is situated in said main portion of said guideway and said guide rod of said second lock means is situated in said offset portion of said guideway to a second position wherein said guide rod of said first lock means is situated in said offset portion of said guideway and said guide rod of said second lock means is situated in said main portion of said guideway, whereby said plunger unit of said first and second lock means are prevented from simultaneously assuming an inward position.

2. An interlock assembly as claimed in claim 1 wherein each said frame member includes a base and opposite side legs forming a generally U-shape, each said plunger bar unit comprising a plunger bar in generally parallel relationship to said base on a first side of said base, and a second bar in generally parallel relationship to said base on an opposite side of said base and intermediate said side legs, each said base having an aperture, a fastener fixedly connecting said plunger bar to said second bar a predetermined distance from said second bar, said fastener extending through said aperture in said base, said second bar having a generally U-shaped cross section with the bridge portion positioned in generally parallel relationship to said base and the legs of said second bar extending away from said base in generally parallel relationship to the opposite side legs of said frame, said bridge portion of said second bar including an aperture, a pin extending upward from the base of the frame through said aperture in said second bar in generally parallel relationship with the opposite side legs of the frame and having a distal end portion positioned intermediate the free ends of the opposite side legs of said frame, said biasing means comprising a spring encircling said pin having a first end retained about said pin at the distal end thereof and a second end biasing said second bar in a first position in proximate association with said base, a pivot rod extending between the opposite side legs of said second bar, a pair of said stop links connected at its one end to said pivot rod, said guide rod extending through said stop links at an opposite end, said guideway comprising a generally dog-leg shaped aperture formed in each side leg of said frame in mirror image relationship to each other, the opposite ends of said guide rod extending respectively through said apertures, a retaining clip on each end of said guide rod exterior of said side legs of said frame, and a connecting link in each said subassembly connected at one end to said guide rod and at an opposite end to said reciprocally movable ends of said flexible cable.

3. An interlock assembly as claimed in claim 2 including a generally U-shaped mounting bracket connected to said frame of each subassembly, each said mounting bracket including an aperture, said cable extending through said aperture and connected to said mounting bracket.

4. An interlock assembly as claimed in claim 2 wherein said base includes a pair of spaced apart apertures, said plunger bar includes a pair of openings, a pair of screws each extending through one of said openings in said plunger bar and having a head of greater diameter than said respective openings, said screws being threadingly received by the bridge portion of said second bar and a sleeve member extending through said apertures of said base having a first end engaged with said plunger bar and an opposite end engaged with said bridge portion of said second bar.

5. An interlock assembly claimed in claim 4 wherein said pin includes a passage through said distal end portion; a clip extending through said passage; and a washer intermediate said spring and said clip retaining said biasing spring about said pin.

*6. An interlock assembly for a first circuit interrupter* separated from a second circuit interrupter by a predetermined distance, each circuit interrupter having at least one main set of contacts and a plunger associated with each main set of contacts, said plungers adapted to reciprocate to an outward position in response to said associated contacts assuming a closed position and to an inward position in response to said associated contacts assuming an open position, said assembly comprising:

a pair of subassemblies, each subassembly comprising:

a generally U-shaped frame including a base and opposite side legs;

a bar having a generally U-shaped cross section biased toward a first location in nested engagement with said frame and mounted for reciprocal movement to a second location away from said base;

a pivot rod extending between the legs of said bar;

a pair of links connected at a first end to said pivot rod;

a guide rod extending through said links at an opposite end;

said opposite side legs of said frame each including a generally dog leg shaped aperture in mirror image relationship to each other;

said aperture having an elongate portion and an offset portion, said offset portion located adjacent said base, said guide rod including opposite ends respectively extending through said apertures, a bracket having a first and second end, said first end connected to said guide rod;

a push/pull cable having opposite ends fixedly mounted to a respective subassembly and having reciprocally movable end portions, each end portion respectively connected to said second end of the bracket of the respective subassemblies;

said guide rod being pivotable about said pivot rod from a first position within said elongate portion of said aperture to a second position within said offset portion of said aperture, said guide rod being reciprocally movable away from said base along said elongate portion in response to said rod assuming said first position and said bar being moved to said second location;

said cable operably associated with said bracket and guide rod of each subassembly such that said guide rods of said first and second subassemblies cannot simultaneously assume said first position whereby said bars of said first and second subassemblies cannot simultaneously assume said second location.

7. An interlock assembly as claimed in claim 6 wherein said base includes an opening through which one of said plungers may extend to urge said bar to said second location.

8. An interlock assembly as claimed in claim 6 including a plunger bar, said base including an aperture, a fastener fixedly connecting said plunger bar to said bar a predetermined distance from said bar, said fastener extending through said aperture.

9. An interlock assembly as claimed in claim 6 including a generally U-shaped mounting bracket connected to said frame of each subassembly, each said mounting bracket including an aperture, said cable extending through said aperture and connected to said mounting bracket.

10. An interlock assembly as claimed in claim 9 including mounting securing means for adjustably securing said cable to said mounting bracket.

11. An interlock assembly as claimed in claim 10 including end securing means for adjustably securing said movable end portions to said second end of said bracket in the respective subassemblies.

* * * * *